US011584119B2

(12) United States Patent
Nagane

(10) Patent No.: US 11,584,119 B2
(45) Date of Patent: Feb. 21, 2023

(54) CONTROL BOARD AND LIQUID EJECTION DEVICE

(71) Applicant: TOSHIBA TEC KABUSHIKI KAISHA, Tokyo (JP)

(72) Inventor: Ryuta Nagane, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 74 days.

(21) Appl. No.: 17/347,512

(22) Filed: Jun. 14, 2021

(65) Prior Publication Data

US 2022/0072849 A1 Mar. 10, 2022

(30) Foreign Application Priority Data

Sep. 10, 2020 (JP) ..... JP2020-152173

(51) Int. Cl.
*B41J 2/045* (2006.01)
*B41J 2/14* (2006.01)

(52) U.S. Cl.
CPC ..... *B41J 2/04501* (2013.01); *B41J 2/14* (2013.01); *B41J 2002/14491* (2013.01)

(58) Field of Classification Search
CPC ..... B41J 2002/14491; B41J 2/04501; B41J 29/38
See application file for complete search history.

(56) References Cited

U.S. PATENT DOCUMENTS 10,500,847 B2 12/2019 Nitta et al.
10,513,112 B2 12/2019 Nitta
10,654,263 B2 5/2020 Nitta
2016/0288513 A1* 10/2016 Wang ..... B41J 2/1753
2019/0160811 A1* 5/2019 Nakajima ..... B41J 2/04586

FOREIGN PATENT DOCUMENTS

EP 2711844 A1 3/2014
KR 20080051096 A * 5/2008

OTHER PUBLICATIONS

Imanaka, MachineTranslationofKR-20080051096-A, 2008 (Year: 2008).*
Extended European Search Report dated Dec. 23, 2021 in corresponding European Patent Application No. 21185429.4, 7 pages.

* cited by examiner

*Primary Examiner* — Scott A Richmond
(74) *Attorney, Agent, or Firm* — Kim & Stewart LLP

(57) ABSTRACT

A control board connectable to a liquid ejection head includes a power supply circuit outputting a first voltage, a connector connectable to a cable through which the first voltage is input and a second voltage is output, and a processor detecting a connection error of the cable using a difference between the first and second voltages, and control the circuit to turn off upon detection of the error. The connector includes first, second, and third terminals adjacent to each other and arranged along a direction in this order and fourth, fifth, and sixth terminals adjacent to each other and arranged along the first direction in this order. The first voltage is input to the second terminal, the second voltage is output from the fifth terminal, and the first, third, fourth, and sixth terminals are ground terminals. The second and fifth terminals are short-circuited in the liquid ejection head.

20 Claims, 10 Drawing Sheets

CONTROL BOARD AND LIQUID EJECTION DEVICE

CROSS-REFERENCE TO RELATED APPLICATION

This application is based upon and claims the benefit of priority from Japanese Patent Application No. 2020-152173, filed on Sep. 10, 2020, the entire contents of which are incorporated herein by reference.

FIELD

Embodiments described herein relate generally to a control board and a liquid ejection device.

BACKGROUND

In the related art, there is a liquid ejection device that includes a liquid ejection head and a liquid tank for storing the liquid to be supplied to the liquid ejection head. A circuit board of the liquid ejection head and a control board are connected with a connector, such as a flexible cable or flexible board, during an inspection process or when installing the liquid ejection head into a liquid ejection apparatus. However, when a flexible connector that has terminals having poles with a narrow pitch is being connected, the connector may be inserted at angle into the circuit board or the control board during the connection process, which may cause a poor connection. That is, when the flexible board is obliquely inserted into a connector of the circuit board or the control board, a position of one or more terminals may be shifted and this may result in a short-circuiting to an adjacent terminal, and thus, the circuit board or the control board of the liquid ejection head may be broken. One known solution for such a problem when there is an element that is likely to be broken during assembly steps on the control board is to incorporate a socket so that the element can be replaced easily, but inclusion of sockets may be cumbersome.

DETAILED DESCRIPTION

One or more embodiments described herein provide a control board capable of detecting oblique insertion of a flexible cable.

In general, according to one embodiment, a control board connectable to a liquid ejection head includes a power supply circuit configured to output a first voltage, a connector connectable to a flexible cable through which the first voltage is input to the liquid ejection head and a second voltage is output from the liquid ejection head, and a processor. The processor is configured to detect a connection error of the flexible cable using a difference between voltage values of the first and second voltages, and control the power supply circuit to turn off upon detection of the connection error. The connector includes a plurality of terminals including first, second, and third terminals that are adjacent to each other and arranged along a first direction in this order and fourth, fifth, and sixth terminals that are adjacent to each other and arranged along the first direction in this order. The first voltage is input to the second terminal, the second voltage is output from the fifth terminal, and the first, third, fourth, and sixth terminals are ground terminals. The second and fifth terminals are short-circuited in the liquid ejection head.

First Embodiment

A liquid ejection device 1 according to a first embodiment will be described below with reference to FIGS. 1 to 7. In addition, for the explanation of each figure, one or more elements may be illustrated to be enlarged, reduced, or omitted as appropriate.

Figure 1:
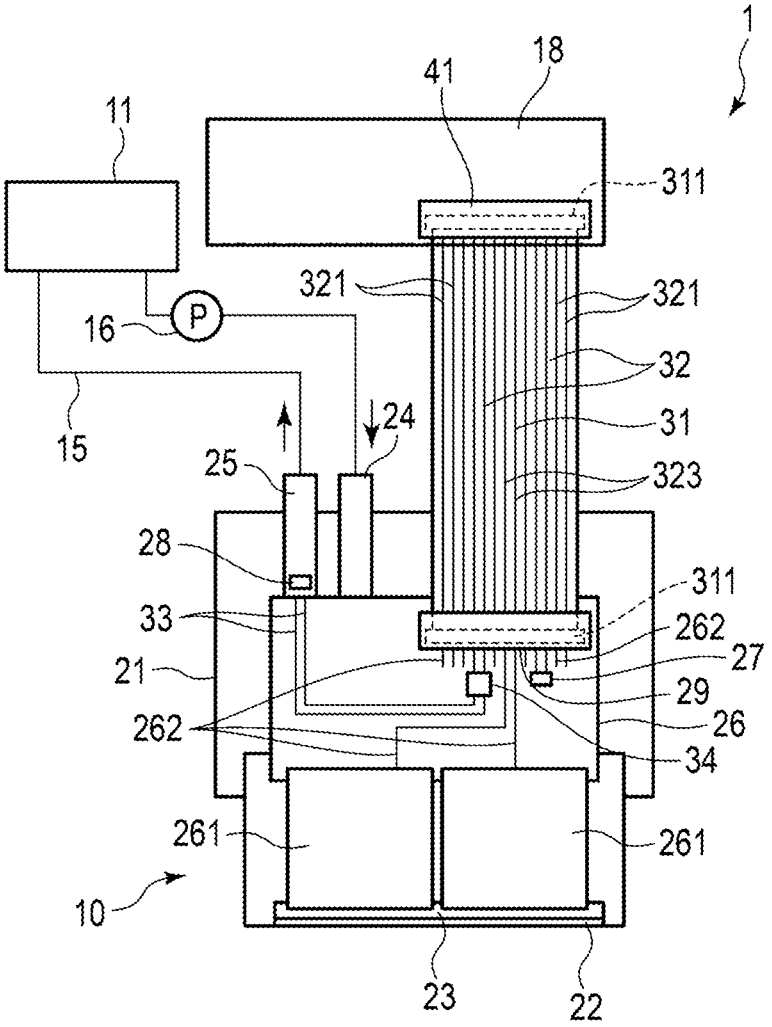
FIG. 1 is a schematic diagram illustrating a liquid ejection device according to a first embodiment.
Figure 2:
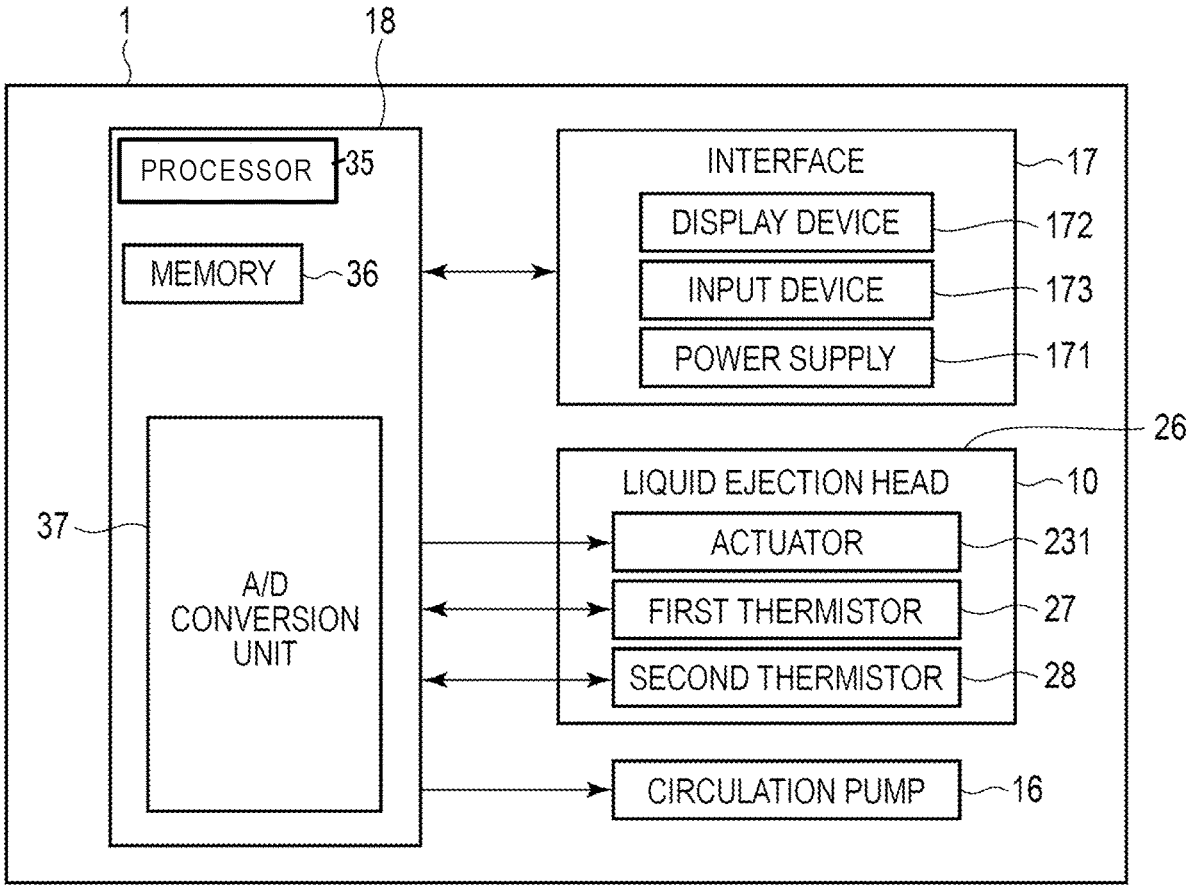
FIG. 2 is a hardware block diagram illustrating a liquid ejection device.
Figure 3:
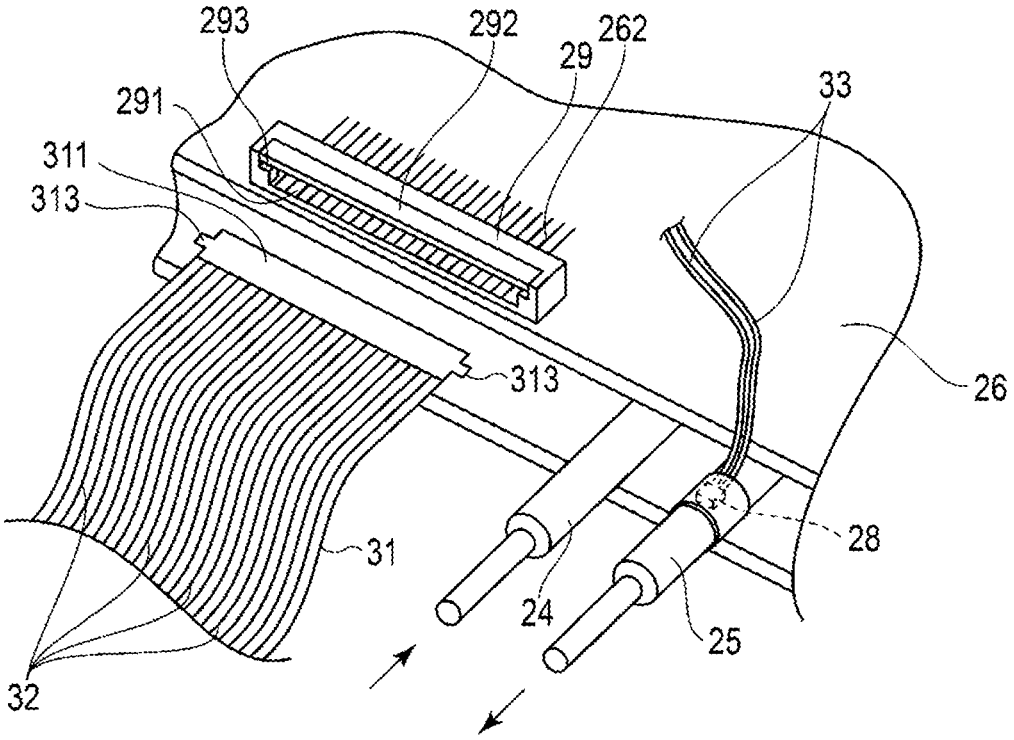
FIG. 3 is an enlarged perspective view of a liquid ejection device.
Figure 4:
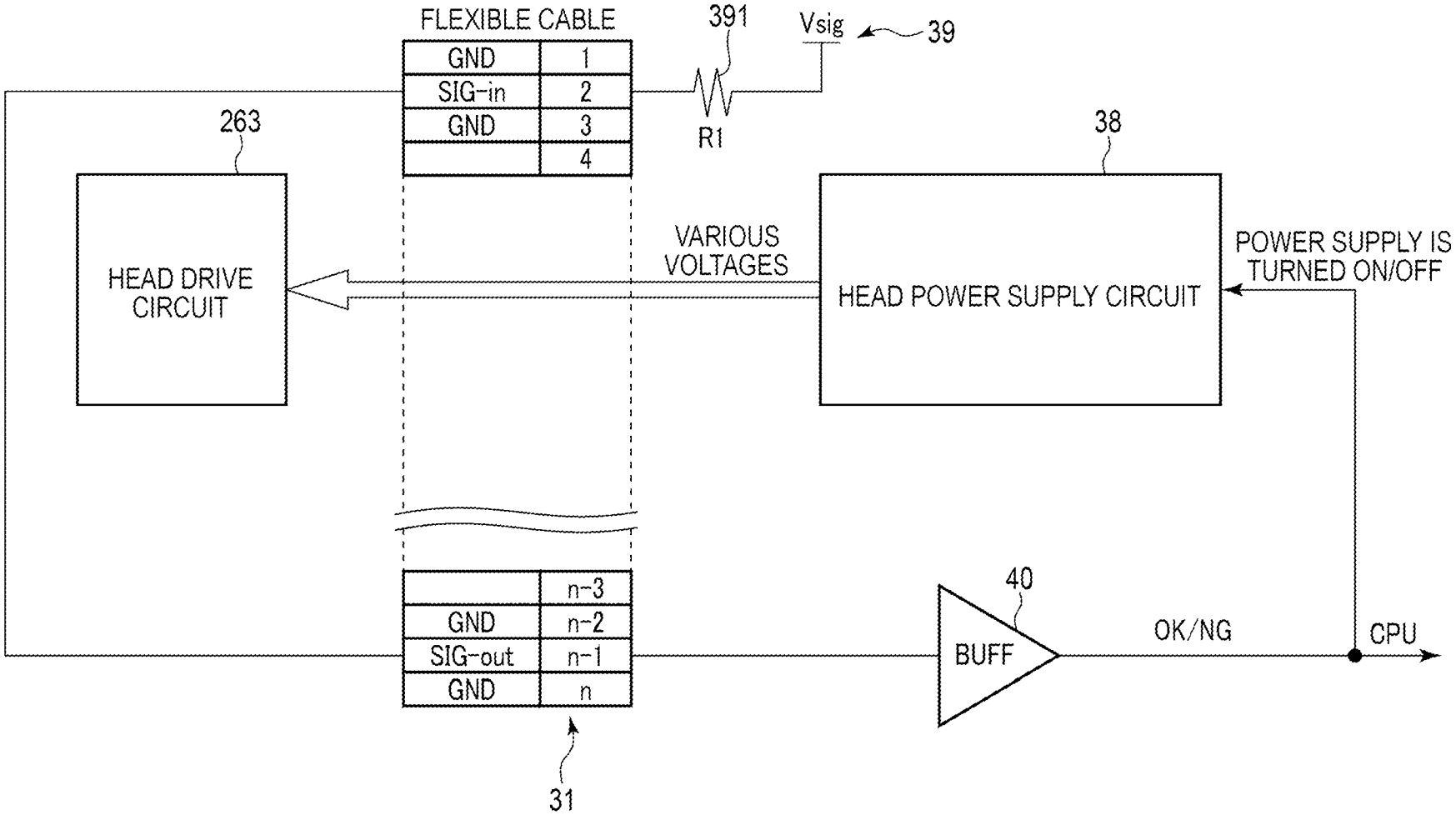
FIG. 4 is a circuit diagram of a liquid ejection device.
Figure 5:
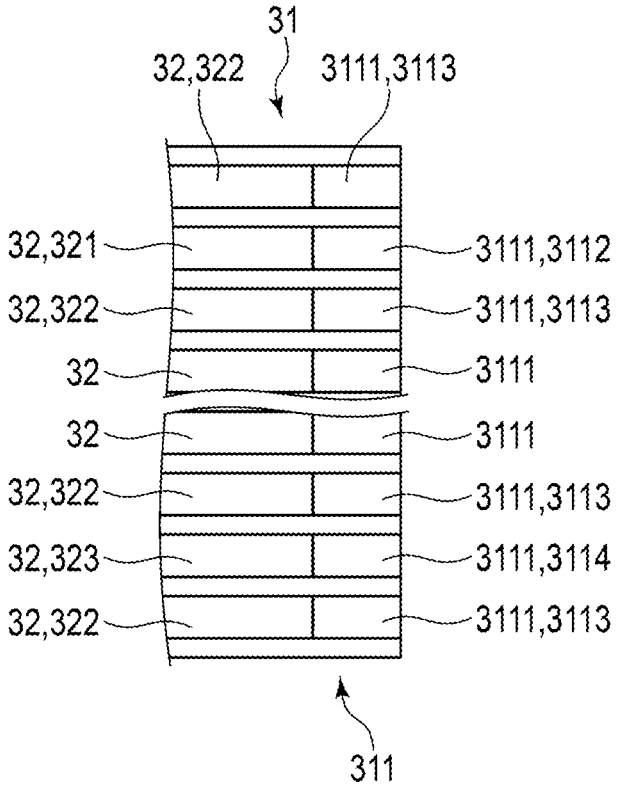
FIG. 5 is a schematic plan view of a terminal unit of a flexible cable of a liquid ejection device.
Figure 6:
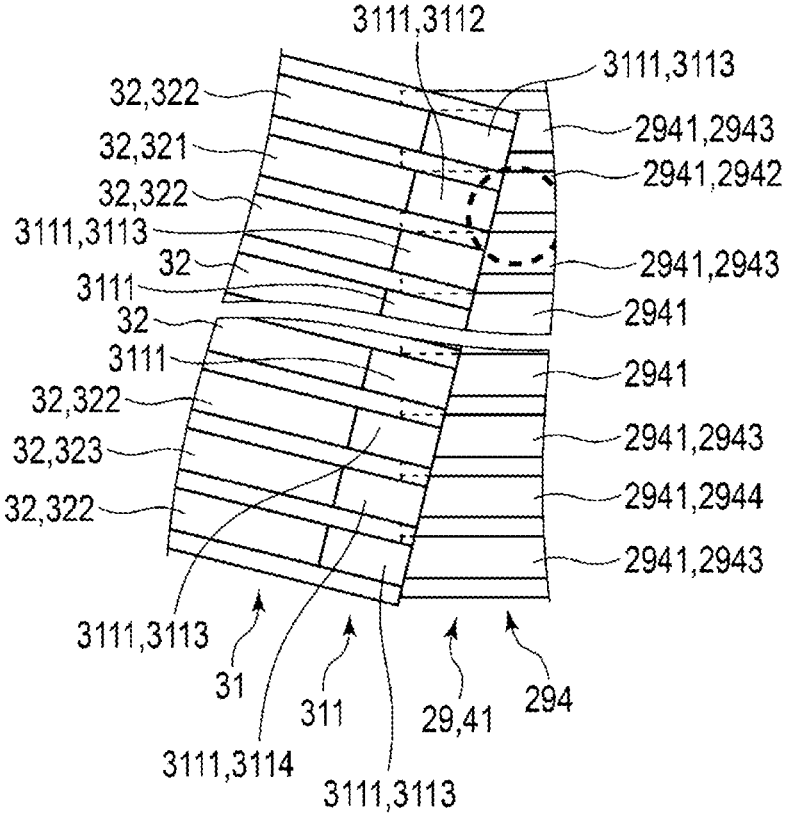
FIG. 6 is an explanatory view illustrating oblique insertion of a liquid ejection head and a flexible cable.
Figure 7:
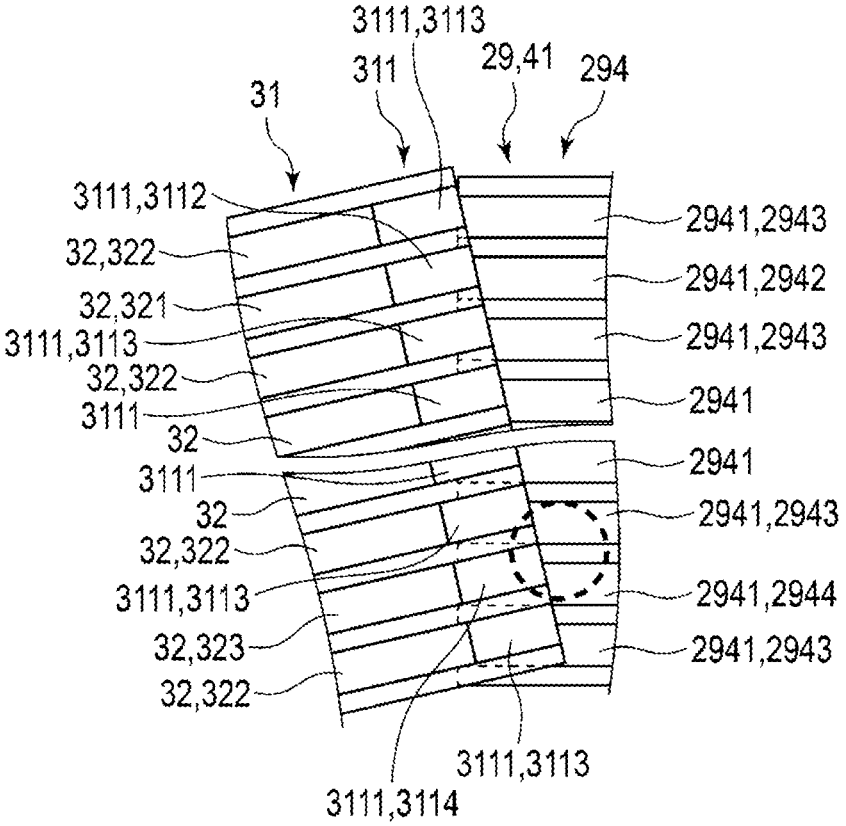
FIG. 7 is an explanatory view illustrating oblique insertion of a liquid ejection head and a flexible cable.

FIG. 1 is a schematic diagram illustrating the liquid ejection device 1, and FIG. 2 is a hardware block diagram thereof. FIG. 3 is an enlarged perspective view of the liquid ejection device 1, and FIG. 4 is an explanatory view illustrating an example of a circuit configuration of the liquid ejection device 1. FIG. 5 is a schematic plan view of a second terminal unit 311 of a flexible cable 31 of the liquid ejection device 1. FIGS. 6 and 7 are explanatory views illustrating examples of oblique insertion or connections of the flexible cable 31 and a connector 29 of a liquid ejection head 10.

The liquid ejection device 1 illustrated in FIGS. 1 and 2 includes the liquid ejection head 10 and a control board 18. The liquid ejection device 1 is, for example, an inspection device that can be used for pre-shipping inspections such as operation confirmation testing and/or performance testing of the liquid ejection head 10 that is typically performed after the manufacturing of the liquid ejection head 10 or an image forming device such as an inkjet recording device incorporating a liquid ejection head 10. That is, the control board 18 of this example may be a control board used in a device provided for purposes of inspection/testing of liquid ejection heads 10 or may be a control board in actual final/shipped products. It is noted that the liquid ejection device 1 when used as an inspection device does not need to be able to actually cause a liquid to be ejected from the liquid ejection head 10 but rather may be a processing device that can perform various inspections related to liquid ejection from the liquid ejection head 10 being tested.

The configuration of the liquid ejection device 1 described herein is an example, and when the liquid ejection device 1 is used as an inspection device or an image forming device, the liquid ejection device 1 of some examples may omit one or more elements described hereinafter, and the liquid ejection device 1 of some examples may further include one or more elements additional elements or components.

As a specific example, the liquid ejection device 1 includes, for example, a liquid ejection head 10, an ink tank 11, a circulation path 15, a circulation pump 16, an interface 17, and a control board 18. In addition, the liquid ejection device 1 includes, for example, a conveying device for moving a recording medium along a conveyance path including a printing position facing the liquid ejection head 10, a maintenance device for performing maintenance on the liquid ejection head 10, various sensors for detecting performance of the liquid ejection head 10, and components for making various adjustments to the performance of the liquid ejection device 1.

The liquid ejection head 10 ejects, for example, a liquid such as an ink. The liquid ejection head 10 is a circulation type head that is connected to the ink tank 11 and circulates the ink between the liquid ejection head 10 and the ink tank 11. The liquid ejection head 10 ejects the ink to form a desired image on a recording medium conveyed to face the liquid ejection head 10. The ink tank 11 stores a liquid such as an ink to be supplied to the liquid ejection head 10. The ink tank 11 is connected to the liquid ejection head 10 via the circulation path 15. The ink tank 11 includes a temperature control device configured with, for example, heat radiation fins, a heater, a heat exchange module, and the like. The temperature control device heats or cools the ink in the ink tank 11 to adjust the temperature of the ink.

The liquid ejection head 10 includes a housing 21, a nozzle plate 22 on which a plurality of nozzles are formed, an actuator unit 23, a supply pipe 24, a recovery pipe 25, a circuit board 26, a first thermistor 27 as a first temperature sensor, and a second thermistor 28 as a second temperature sensor. In one embodiment, the nozzle plate 22 on which the plurality of nozzles are formed and the actuator unit 23 make up a liquid ejection unit.

The nozzle plate 22, which is a portion of the liquid ejection unit, is formed in a rectangular plate shape and is supported by the housing 21. The nozzle plate 22 has the plurality of nozzles which are arranged in parallel along one direction.

The actuator unit 23, which is a portion of the liquid ejection unit, is arranged to face a side opposite to a printing side of the nozzle plate 22 and is supported by the housing 21. For example, a predetermined flow path including a plurality of pressure chambers communicating with the nozzles of the nozzle plate 22 and a common chamber communicating with the plurality of pressure chambers is formed inside the actuator unit 23. An actuator 231 (see FIG. 2) is provided at a portion facing each pressure chamber. The actuator 231 includes, for example, a unimorph type piezoelectric vibrating diaphragm in which a piezoelectric element and a vibrating diaphragm are stacked. The piezoelectric element is made of a piezoelectric ceramic material such as lead zirconate titanate (PZT). An electrode is formed to face the pressure chamber, and the electrode is electrically connected to a drive IC 261 or a plurality of drive ICs 261.

The supply pipe 24 and the recovery pipe 25 include, for example, a pipe made of a metal or other heat conductive material, and a tube covering the outer surface of the pipe, for example, a PTFE (Polytetrafluoroethylene) tube. The actuator unit 23, the supply pipe 24, and the recovery pipe 25 form a predetermined flow path in the liquid ejection heat 10.

The supply pipe 24 is a tubular member that communicates with the upstream side of the common chamber of the actuator unit 23 and forms a predetermined flow path that communicates with the ink tank 11. By the operation of the circulation pump 16, the liquid in the ink tank 11 is transferred to the pressure chamber of the actuator unit 23 through the supply pipe 24.

The recovery pipe 25 is a tubular member that communicates with the downstream side of the common chamber of the actuator unit 23 and forms a predetermined flow path that communicates with the ink tank 11. By the operation of the circulation pump 16, the liquid is transferred from the common chamber to the ink tank 11 through the recovery pipe 25. The second thermistor 28 is provided on, for example, an outer peripheral surface of the recovery pipe 25. The second thermistor 28 detects the temperature of the ink passing through the recovery pipe 25.

The circuit board 26 is provided on, for example, a side surface of the liquid ejection head 10 and is fixed to the housing 21. The circuit board 26 includes, for example, the drive ICs 261 and a predetermined wiring pattern 262. Each of the drive ICs 261 is electrically connected to electrodes of the actuator 231. It is noted that the circuit board 26 includes a flexible board. For example, the drive IC 261 may be mounted on the flexible board or the like and connected to the electrodes of the actuator 231 through the flexible board. The circuit board 26 makes up a head drive circuit 263 that drives the liquid ejection head 10 by the drive ICs 261.

In addition, the circuit board 26 includes a first connector 29 mounted at a predetermined portion. The first connector 29 includes a slit-shaped insertion port 291 (see FIG. 3) into which one end of the flexible cable 31 for connection with the control board 18 can be inserted, a retaining cover 292 which retains one end of the flexible cable 31 inserted into the insertion port 291, a restriction protrusion 293 which restricts a positional relationship with one end of the flexible cable 31, and a first terminal unit 294 (see FIG. 6) which is provided at the insertion port 291. The connector 29 is mechanically and electrically connected to the corresponding flexible cable 31.

The restriction protrusions 293 are provided at both ends in a width or longitudinal direction of the insertion port 291. The first terminal unit 294 includes a plurality of first terminals, referred to as connector terminals 2941 (see FIG. 6), which are arranged in parallel along one direction and connected to a plurality of second terminals 3111 of the second terminal unit 311 described later of the flexible cable 31.

For example, with respect to the first terminal unit 294, the first terminal 2941 on one end side of the plurality of first terminals 2941 in the arrangement direction is set as the first signal input terminal 2942 to which the signal voltage Vsig is input, and the two first terminals 2941 adjacent to the first signal input terminal 2942 are set as first GND terminals 2943.

In addition, with respect to the first terminal unit 294, the first terminal 2941 on the other end side of the plurality of first terminals 2941 in the arrangement direction is set as the first signal output terminal 2944 to which the signal voltage Vsig is output, and the two first terminals 2941 adjacent to the first signal output terminal 2944 are set as first GND terminals 2943.

Herein, the first signal input terminal 2942 and the first signal output terminal 2944 are electrically connected. The first signal input terminal 2942 and the first signal output terminal 2944 are connected by, for example, the wiring pattern 262.

The retaining cover 292 opens and closes the insertion port 291 by a rotating operation. The retaining cover 292 can retain the second terminal unit 311 provided at one end of the flexible cable 31 and can release the retainment of the second terminal unit 311. For example, the second terminal unit 311 of the flexible cable 31 is inserted into the insertion port 291 of the connector 29, and by covering with the retaining cover 292 and pressing from the above, the second terminal 3111 of the flexible cable 31 and the first terminal 2941 of the connector 29 are electrically connected. Therefore, the control board 18 and the circuit board 26 are electrically and mechanically connected through the flexible cable 31.

The first thermistor 27 is a first temperature sensor provided on the circuit board 26 in the vicinity of the connector 29.

The first thermistor 27 is a chip component and is mounted directly on the circuit board 26. For example, the first thermistor 27 is arranged in the vicinity of one end of the connector 29. The first thermistor 27 is electrically connected to a connection terminal which is arranged on one end side of the connector 29 on the circuit board 26 by, for example, the wiring pattern 262. The first thermistor 27 detects the temperature inside the housing 21. It is noted that, the first thermistor 27 is arranged closer to the drive IC 261 than the second thermistor 28.

The second thermistor 28 is bonded to the outer surface of the recovery pipe 25 which forms a portion of the flow path. The second thermistor 28 is electrically connected to the connection terminal arranged on the other end side of the connector 29 on the circuit board 26 by a signal cable 33. The second thermistor 28 is provided in the flow path on the downstream side of the actuator 231 and detects the temperature of the liquid after passing through the actuator 231.

The thermistor connector 34 is, for example, a 2-pin connector dedicated for a thermistor and is mounted on the circuit board 26. The thermistor connector 34 is connected to the connector 29 through the wiring pattern 262. The thermistor connector 34 is connected to, for example, two first terminals 2941 among the plurality of first terminals 2941 excluding the first signal input terminal 2942, the first GND terminals 2943, and the first signal output terminal 2944.

The flexible cable 31 is, for example, a strip-shaped wiring board having flexibility and a certain width. The flexible cable 31 includes a plurality of signal lines 32 which are wiring patterns extending along a longitudinal direction of the flexible cable 31. The flexible cable 31 is, for example, a flexible printed circuit (FPC).

As illustrated in FIGS. 1, and 3 to 5, the flexible cable 31 has second terminal units 311 at both ends in the longitudinal direction thereof. The plurality of signal lines 32 of the flexible cable 31 are arranged in parallel along the width direction perpendicular to the longitudinal direction. The flexible cable 31 is, for example, a so-called flexible board in which a copper foil on a copper-coated polyimide film is patterned and a pattern portion excluding the second terminal unit 311 is laminated with a film.

The second terminal unit 311 includes the plurality of second terminals, referred to as cable terminals 3111, connected to the plurality of first terminals 2941 that are arranged in parallel along one direction. The second terminal unit 311 is inserted into the connector 29 and is electrically and mechanically connected thereto, and the plurality of second terminals 3111 are connected to the respective plurality of signal lines 32. As illustrated in FIG. 3, the second terminal unit 311 has, for example, restriction pieces 313 that are positioned by engaging with the restriction protrusions 293 at both end edges in the width direction which is the arrangement direction of the plurality of second terminals 3111.

For example, in the flexible cable 31, in the arrangement direction of the plurality of signal lines 32 (corresponding to the arrangement direction of the plurality of second terminal units 311), the signal line 32 and the second terminal 3111 on one end side are set as the signal input signal line 321 and the second signal input terminal 3112 to which the signal voltage Vsig is input. In the flexible cable 31, in the arrangement direction of the plurality of signal lines 32, two signal lines 32 and two second terminals 3111 adjacent to the signal input signal line 321 and the second signal input terminal 3112 are set as the GND signal lines 322 and the second GND terminal 3113, respectively.

In addition, in the flexible cable 31, in the arrangement direction of the plurality of signal lines 32, the signal line 32 and the second terminal 3111 on the other end side are set as the signal output signal line 323 and the second signal output terminal 3114 from which the signal voltage Vsig is output. In the flexible cable 31, in the arrangement direction of the plurality of signal lines 32, the two signal lines 32 and the two second terminals 3111 adjacent to the signal output signal line 323 and the second signal output terminal 3114 are set as the GND signal line 322 and the second GND terminal 3113.

The circulation path 15 forms a flow path passing through the liquid ejection head 10 and the ink tank 11.

The circulation pump 16 is provided in the circulation path 15. The circulation pump 16 circulates the liquid between the ink tank 11 and the liquid ejection head 10 through the circulation path 15. The circulation pump 16 is, for example, a piezoelectric pump. The piezoelectric pump is connected to the drive circuit by wiring and is controlled under the control of a processor 35 provided on the control board 18. The circulation pump 16 transfers the liquid in the circulation path 15 to the downstream side through a filter.

Through the interface 17, the control board 18 including the processor 35 is connected to a power supply 171, a display device 172, and an input device 173. The processor 35 executes various operations to control the input device 173 operated by a user. In addition, the processor 35 controls the display device 172 to display various information and image. The power supply 171 supplies power to the liquid ejection device 1.

The control board 18 is a control circuit or a controller. As illustrated in FIGS. 2 and 4, the control board 18 includes the processor 35 for controlling operations of each unit, e.g., a memory 36 that stores programs, various data, and the like, an AD (analog to digital) conversion circuit 37 for converting analog data (e.g., voltage values) to digital data (e.g., bit data), a head power supply circuit 38 which supplies electric power to the liquid ejection head 10, a signal voltage output circuit 39 which outputs the signal voltage Vsig as a detection signal, and a buffer (BUFF) circuit 40 (hereinafter simply referred to as the buffer 40).

In addition, the control board 18 includes a second connector 41 mounted at a predetermined portion. The second connector 41 is formed so that the second terminal unit 311 at the other end of the flexible cable 31 for connection with the circuit board 26 can be inserted. For example, the second connector 41 is formed in the same shape as the first connector 29 and includes an insertion port 291, a retaining cover 292, a restriction protrusion 293, and a first terminal unit 294 provided in the insertion port 291. The first terminal unit 294 of the second connector 41 is connected to the head power supply circuit 38, the signal voltage output circuit 39, and the buffer 40.

The processor 35 is, for example, a central processing unit (CPU). The processor 35 controls each unit of the liquid ejection device 1 in order to perform various functions of the liquid ejection device 1 according to an operating system and an application program(s).

The processor 35 controls the head drive circuit 263 configured with the drive IC 261 of the liquid ejection head 10. The processor 35 is connected to various drive mechanisms to control operations of each unit of the liquid ejection device 1 through the AD conversion circuit 37, the liquid ejection head 10, the head power supply circuit 38, and the signal voltage output circuit 39. In addition, the processor 35 executes a control process based on a control program(s) stored in the memory 36. For example, the processor 35 controls a printing operation by controlling the operations of the liquid ejection head 10 and the circulation pump 16. The processor 35 causes a driving voltage to be applied the electrodes through the drive IC 261. When the driving voltage is applied to the electrodes, the actuator is deformed, so that the liquid in the pressure chamber is ejected from the nozzle. In addition, based on the signal output from the buffer 40 and the control program(s) stored in the memory 36, the processor 35 detects and an error and performs an error determination process of the flexible cable 31 and an error management process.

The memory 36 is, for example, a non-volatile memory and is mounted on the control board 18. The memory 36 stores various control programs and operating conditions required for an ink circulation operation, an ink supply operation, temperature control, liquid level control, pressure control, voltage control of the power supply required for controlling the liquid ejection head 10, control of the error determination, the error management, or the like by the oblique insertion of the flexible cable 31.

The head power supply circuit 38 is a processing circuit and outputs various voltages for driving and controlling the liquid ejection head 10 under the control of the processor 35. The head power supply circuit 38 is connected to the head drive circuit 263 through the flexible cable 31.

The signal voltage output circuit 39 is a processing circuit and outputs a signal voltage set as a predetermined voltage value under the control of the processor 35. As illustrated in FIG. 4, the signal voltage output circuit 39 includes, for example, a resistor 391. The signal voltage output circuit 39 is connected to the second signal input terminal 3112 of the second terminal unit 311. The signal voltage output circuit 39 is connected to the buffer 40 through the second signal input terminal 3112, the signal input signal line 321, the first signal input terminal 2942, the wiring pattern 262, the first signal output terminal 2944, the signal output signal line 323, and the second signal output terminal 3114. For example, the voltage value of the signal voltage Vsig output from the signal voltage output circuit 39 is set to 5 V.

The buffer 40 is a processing circuit and outputs a detection signal indicating a voltage value. For example, the buffer 40 outputs the detection signal to the head power supply circuit 38 and the processor 35. The buffer 40 corrects, for example, the voltage that has input thereto and its signal strength.

In addition, as in the circuit diagram illustrated in FIG. 4, preferably, the signal input terminals 2942 and 3112 and the signal output terminals 2944 and 3114 to which the signal voltage output circuit 39 is connected are set as the second terminals from both ends among the plurality of terminals 2941 and 3111. That is, when it is assumed that the number of pins of the terminals 2941 and 3111 is n, the signal input terminals 2942 and 3112 are set as the second terminals from the terminal of one end, and the signal output terminals 2944 and 3114 are set as the (n−1)th terminals from the terminal of one end.

In the liquid ejection device 1, the processor 35 performs a printing process in which printing for ejecting a coat material which is a liquid from the nozzle is performed. In the printing process, when the processor 35 detects an input of instructing the start of printing, the processor 35 controls the operations of the liquid ejection head 10 and the conveying device according to various programs to allow a liquid droplet injection operation to be performed.

For example, before the driving voltage is applied to the liquid ejection head 10, the processor 35 drives the signal voltage output circuit 39 to output the signal voltage Vsig and monitors the detection signal output from the buffer 40. The processor 35 detects from the detection signal of the buffer 40 whether there is an abnormality in the connection between the flexible cable 31 and the first connector 29 or between the flexible cable 31 and the second connector 41.

For example, when the detection signal output from the buffer 40 indicates the value of the signal voltage Vsig, the processor 35 determines that the flexible cable 31 is normally connected to the first connector 29 and the second connector 41.

For example, when the processor 35 determines that the flexible cable 31 is normally connected to the first connector 29 or the second connector 41, the processor 35 controls the head power supply circuit 38 to apply the driving voltage to the liquid ejection head 10.

In addition, for example, when the detection signal output from the buffer 40 indicates a GND voltage, the processor 35 detects whether there is an abnormality in the connection between the flexible cable 31 and the first connector 29 or between the flexible cable 31 and the second connector 41. Herein, the abnormality in the connection between the flexible cable 31 and the first connector 29 or between the flexible cable 31 and the second connector 41 denotes, as illustrated in FIGS. 6 and 7, oblique insertion of the flexible cable 31 into the first connector 29 or the second connector 41. That is, when the flexible cable 31 is obliquely inserted into the connectors 29 and 41, the second signal input terminal 3112 or the second signal output terminal 3114 is short-circuited and the detection signal indicates the GND voltage, the processor 35 determines that the connection is abnormal.

In addition, for example, when the processor 35 determines that the oblique insertion of the flexible cable 31 occurs, the processor 35 controls the head power supply circuit 38 to be turned off or retains the turned-off state of the head power supply circuit 38 so as not to output the driving voltage to the liquid ejection head 10. As described above, the processor 35 performs the error determination process based on the detection signal of the buffer 40.

It is noted that the buffer 40 may be configured to switch turning-on and turning-off of the head power supply circuit 38 based on the detection signal and to perform the error determination process to output the detection signal to the processor 35.

In addition, for example, when the processor 35 determines that the oblique insertion of the flexible cable 31 occurs, the processor 35 performs management of an error state as an error management process. The error management process includes, for example: a process of displaying or notifying error information by a display device or a notification device of an external terminal device connected to the control board 18; a process of storing the error information such as a date and time when the error state occurs and an identification number of the liquid ejection head 10 in the memory 36 of the control board 18; a process of outputting the error information to the external terminal connected to the control board 18, and the like. Such error management process is appropriately set.

Next, specific examples of error determination and error management of the flexible cable 31 and the connectors 29 and 41 by the control board 18 and the liquid ejection device 1 are described with reference to FIGS. 4 to 7.

First, when the operator inserts the flexible cable 31 into the first connector 29 and the second connector 41 and, after that, inputs an error determination command from the input device 173, the processor 35 of the control board 18 controls the signal voltage output circuit 39 to output the signal voltage Vsig. The output signal voltage Vsig is input to the buffer 40, which is originated from the second signal input terminal 3112 and output through the signal input signal line 321 of the flexible cable 31, the first signal input terminal 2942, the wiring pattern 262, the first signal output terminal 2944, the signal output signal line 323, and the second signal output terminal 3114.

When the flexible cable 31 is normally connected to the first connector 29 and the second connector 41, the detection signal output from the buffer 40 indicates the value of the voltage output from the signal voltage output circuit 39. Then, when the detection signal has a normal voltage value, the processor 35 determines that the connection between the flexible cable 31 and the first connector 29 and the connection between the flexible cable 31 and the second connector 41 are normal. Then, the processor 35 controls the head power supply circuit 38 to output various voltages for driving and controlling the liquid ejection head 10.

When the flexible cable 31 is not normally connected to the first connector 29 and the second connector 41 and the second signal input terminal 3112 or the second signal output terminal 3114 is short-circuited, the detection signal output from the buffer 40 indicates the GND voltage.

Specifically, as illustrated in FIGS. 6 and 7, when the flexible cable 31 is obliquely inserted into at least one of the first connector 29 and the second connector 41, the arrangement direction of the second terminal 3111 is slanted with respect to the arrangement direction of the first terminal 2941 of the first connector 29. Then, as illustrated in the region surrounded by a broken line circle in FIG. 6 or 7, the second signal input terminal 3112 or the second signal output terminal 3114 located at the end of the signal input signal line 321 of the flexible cable 31 is in contact with and short-circuited to the first signal input terminal 2942 or the first signal output terminal 2944 and the GND terminal 2943. For this reason, the signal voltage Vsig input to the buffer 40 becomes the GND voltage.

When the detection signal output from the buffer 40 indicates the GND voltage and the processor 35 detects that the detection signal indicates the GND voltage, the processor 35 detects the oblique insertion, i.e., detects that the connection between the flexible cable 31 and the first connector 29 and/or the connection between the flexible cable 31 and the second connector 41 are abnormal. Then, the processor 35 controls the head power supply circuit 38 so as not to output various voltages for driving and controlling the liquid ejection head 10. Therefore, it is possible to prevent various voltages from being output from the head power supply circuit 38 in the state where any of the second terminals 3111 is in contact with and short-circuited to the plurality of first terminals 2941. In addition, the processor 35 performs the error management process while determining the oblique insertion of the flexible cable 31.

According to the control board 18 and the liquid ejection device 1, the signal voltage Vsig output from the signal voltage output circuit 39 is input to the buffer 40 through the flexible cable 31 and the connectors 29 and 41. Then, the detection signal is output from the buffer 40. In addition, the GND terminals are provided on both sides of the terminals which the signal voltage Vsig is input to and output from. Therefore, the oblique insertion of the flexible cable 31 can be detected by comparing the voltage of the detection signal input to the buffer 40 and the signal voltage Vsig.

In addition, when the oblique insertion of the flexible cable 31 is detected, the head power supply circuit 38 does not output various voltages to drive the liquid ejection head 10. Therefore, in the state where the flexible cable 31 is obliquely inserted, the driving voltage is prevented from being supplied to the liquid ejection head 10, and thus, the circuit board 26 such as the head drive circuit 263 of the liquid ejection head 10 and the control board 18 of the head power supply circuit 38 or the like can be prevented from being broken.

For example, when the control board 18 is applied to an inspection device, it is possible to prevent the liquid ejection head 10 from being broken during the shipping inspection of the liquid ejection head 10. For example, when the control board 18 is applied to the inspection device, the flexible cable 31 is connected in advance to the control board 18, and the flexible cable 31 is connected to the liquid ejection head 10 as an inspection target. Therefore, when the flexible cable 31 is inserted into the first connector 29 of the liquid ejection head 10, there is a concern that the oblique insertion may occur. However, according to the inspection device to which the control board 18 according to the above-recited embodiments is applied, since the oblique insertion of the flexible cable 31 can be detected before the various voltages are output from the head power supply circuit 38 to the liquid ejection head 10, it is possible to prevent the liquid ejection head 10 from being broken.

In addition, for example, when the control board 18 is installed in an actual product (e.g., an image forming device and an inkjet recording device) as the liquid ejection device 1, after the manufacturing of the liquid ejection device 1 by assembling the liquid ejection head 10 that is subjected to the inspection with the control board 18 and the like or during the manufacturing of the liquid ejection device 1, it is possible to prevent the liquid ejection head 10, the control board 18, and the like from being broken.

That is, when the flexible cable 31 is inserted into the first connector 29 of the liquid ejection head 10 and the second connector 41 of the control board 18, there is a concern that the oblique insertion may occur. However, according to the liquid ejection device 1 as a product to which the control board 18 according to the above-recited embodiments is applied, it is possible to detect the oblique insertion of the flexible cable 31 before shipping as a product or in an in-process product before completion.

In addition, even when the oblique insertion of the flexible cable 31 occurs, the liquid ejection device 1 can prevent the liquid ejection head 10 and the control board 18 from being broken. In addition, the detection of oblique insertion is also effectively performed in a shipping inspection of the liquid ejection device 1.

Furthermore, in maintenance or part replacement of the liquid ejection device 1, after the flexible cable 31 is pulled out from the liquid ejection head 10 or the control board 18, when the flexible cable 31 is inserted again, for example, the oblique insertion can be effectively detected.

In addition, by performing the error management process after the error detection, the control board 18 can prevent the flexible cable 31 from being shipped in the obliquely inserted state. In addition, when the oblique insertion of the flexible cable 31 occurs, by storing the error information in the memory 36 by error management, the error information can be utilized for improvement of production technology such as reviewing the insertion work of the flexible cable 31.

According to the control board 18 and the liquid ejection device 1 according to the embodiments described above, it is possible to determine whether the oblique insertion of the flexible cable 31 into the connectors 29 and 41 occurs.

Second Embodiment

Figure 9:
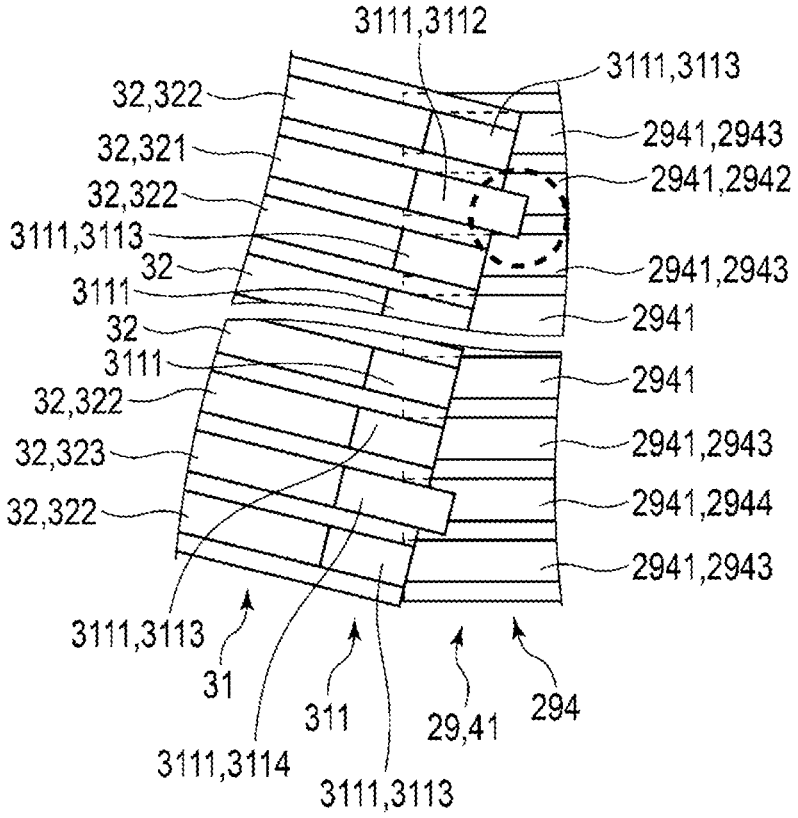
FIG. 9 is an explanatory view illustrating oblique insertion of a liquid ejection head and a flexible cable.
Figure 10:
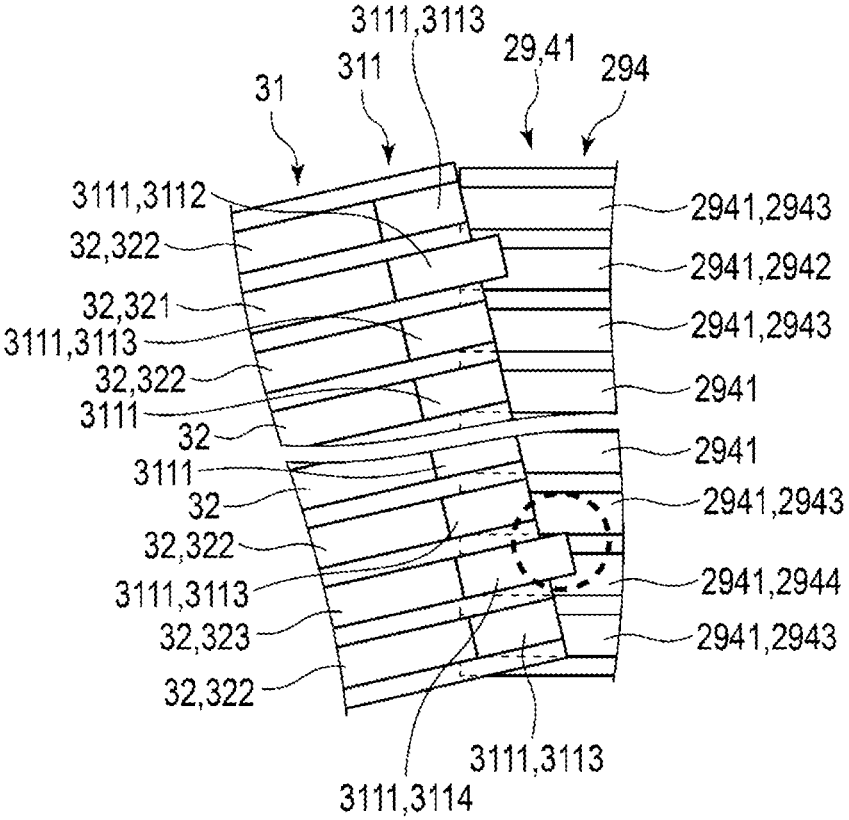
FIG. 10 is an explanatory view illustrating oblique insertion of a liquid ejection head and a flexible cable.

Next, configurations of the control board 18 and the liquid ejection device 1 according to a second embodiment will be described with reference to FIGS. 8 to 10. The control board 18 and the liquid ejection device 1 according to the second embodiment are different from the control board 18 and the liquid ejection device 1 according to the first embodiment described above in terms of the shape of the second terminal unit 311 of the flexible cable 31. Other components are the same as those of the first embodiment. For this reason, among the components of the second embodiment, the same components as the first embodiment are denoted by the same reference numerals, and detailed description thereof will be omitted.

Figure 8:
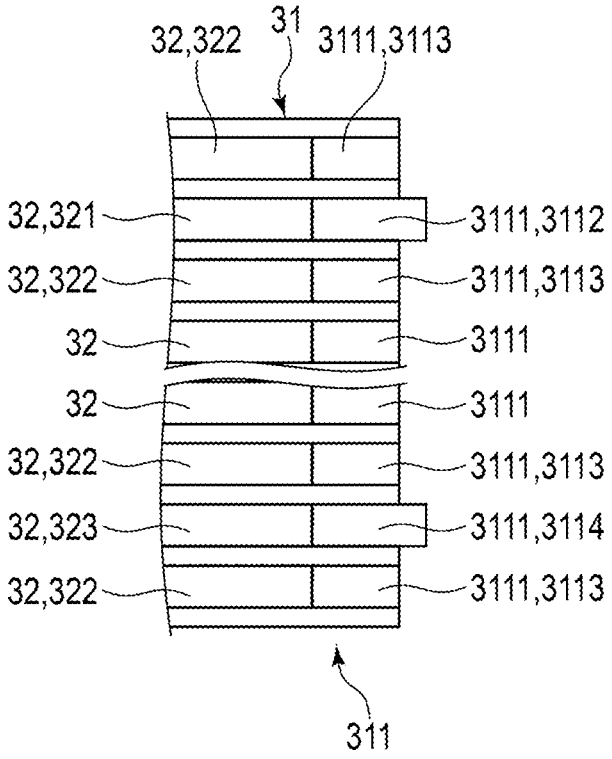
FIG. 8 is a schematic plan view of a terminal unit of a flexible cable used in a liquid ejection device according to a second embodiment.

As illustrated in FIG. 8, with respect to the second terminal unit 311 of the flexible cable 31 used in the control board 18 and the liquid ejection device 1 according to the second embodiment, each of the second signal input terminal 3112 and the second signal output terminal 3114 is longer than the other second terminals 3111. That is, in the flexible cable 31, among the plurality of second terminals 3111, the second signal input terminal 3112 and the second signal output terminal 3114 protrude.

According to the control board 18 and the liquid ejection device 1 according to the second embodiment, when the flexible cable 31 is inserted into the first connector 29 or the second connector 41, the second signal input terminal 3112 and/or the second signal output terminal 3114 are in contact with the first terminal 2941 of the first connector 29 or the second connector 41 before the other second terminal 3111. For this reason, when the flexible cable 31 is obliquely inserted, before the other second terminals 3111 are in contact with the first terminals 2941 of the first connector 29 or the second connector 41, the signal voltage Vsig can be detected via the buffer 40.

Therefore, for example, the control board 18 can prevent driving voltage short circuit even when the head power supply circuit 38 is turned on and can determine whether the oblique insertion of the flexible cable 31 occurs. It is noted that, as a modified example according to the second embodiment, the second signal input terminal 3112 and the second signal output terminal 3114 may be longer than the other second terminals 3111, and the first signal input terminal 2942 and the first signal output terminal 2944 may be longer than the other first terminals 2941. Alternatively, the first signal input terminal 2942 and the first signal output terminal 2944 may be longer than the other first terminals 2941 instead of a configuration in which the second signal input terminal 3112 and the second signal output terminal 3114 are longer than the other second terminals 3111.

According to the control board 18 and the liquid ejection device 1 according to the second embodiment described above, it is possible to determine the oblique insertion of the flexible cable 31.

The present invention is not limited to each of the above embodiments. For example, in the above-described embodiments, FPC is exemplified as an example of the flexible cable 31 for connecting the circuit board 26 and the control board 18. However, it is possible to use another wiring connector such as a card wire (flat flexible cable (FFC)) in which a portion of a plurality of ribbon-shaped copper foil wirings excluding the connection terminal units of both ends in the longitudinal direction is laminated with a film. That is, when the flexible cable 31 has a plurality of terminals, any two terminals of the plurality of terminals are used as the signal input terminal and the signal output terminal for inputting and outputting the signal voltage Vsig, respectively, and the terminals adjacent to the input and output terminals can be the GND terminals, it is possible to determine short-circuit due to oblique insertion of the flexible cable 31.

In addition, in the embodiments described above, the detection signal is output from the buffer 40 to the processor 35, and the turning on and off of the head power supply circuit 38 is controlled under the control of the processor 35. However, as the buffer 40 for detecting the oblique insertion of the flexible cable 31, for example, a window comparator circuit may be used, which has a function of a buffer and can determine whether the input voltage value is between two reference voltages. That is, when the detection signal output by the window comparator circuit indicates a voltage value within a normal voltage value range (which in this context is a predetermined voltage range including the signal voltage Vsig) where the short circuit to the signal voltage Vsig does not occur, it can be determined that the short circuit does not occur and the flexible cable 31 is normally connected to the first connector 29 and the second connector 41. In addition, when the detection signal detected by the window comparator circuit indicates a voltage value outside the normal voltage value range where the short circuit to the signal voltage Vsig does not occur, it can be determined that the short circuit occurs and the flexible cable 31 is obliquely inserted into the first connector 29 and the second connector 41.

As described above, the window comparator circuit including the buffer may be applied to the control board 18. In addition, in such a case, Vsig may be a voltage lower than the power supply voltage, and for example, when the power supply voltage is 5 V, Vsig may be 2.5 V.

In addition, the liquid to be ejected is not limited to the ink, and a liquid other than the ink may be ejected. The liquid ejection device for ejecting a liquid other than the ink may be, for example, a device or the like for ejecting a liquid containing conductive particles for forming a wiring pattern of a printed wiring board.

In addition to the above description, the liquid ejection head 10 may have, for example, a structure in which the diaphragm is deformed by static electricity to eject ink droplets or a structure in which ink droplets are ejected from a nozzle by using thermal energy of a heater or the like.

In addition, in the above-described embodiments, the liquid ejection device and the control board 18 are used for an inspection device and an inkjet recording device, but the present embodiments are not limited thereto, and, for example, the present embodiments can be used for a 3D printer, an industrial manufacturing machine, a medical treatment application.

According to the control board and the liquid ejection device according to each embodiment configured as described above, it is possible to detect the oblique insertion of the flexible cable.

While certain embodiments have been described these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A control board for a liquid ejection head, the control board comprising:

a power supply circuit configured to output a first voltage;

a connector connectable to a flexible cable through which the first voltage is input to the liquid ejection head and a second voltage is output from the liquid ejection head; and a processor configured to:

detect a connection error of the flexible cable using a difference between voltage values of the first and second voltages, and control the power supply circuit to turn off upon detection of the connection error, wherein the connector includes a plurality of terminals including:

first, second, and third terminals that are adjacent to each other and arranged along a first direction in this order and fourth, fifth, and sixth terminals that are adjacent to each other and arranged along the first direction in this order, the first voltage is input to the second terminal, the second voltage is output from the fifth terminal, and the first, third, fourth, and sixth terminals are ground terminals, and the second and fifth terminals are short-circuited in the liquid ejection head.

2. The control board according to claim 1, wherein the processor detects the connection error when the voltage value of the second voltage is different from the first voltage.

3. The control board according to claim 2, further comprising:

a memory, wherein the processor is further configured to store information indicating whether the connection error is detected in the memory.

4. The control board according to claim 2, wherein the processor detects the connection error when the voltage value of the second voltage is a ground voltage value.

5. The control board according to claim 1, wherein two of a plurality of cable terminals of the flexible cable corresponding to the second and fifth terminals of the connector are longer than the other cable terminals.

6. The control board according to claim 5, wherein the two of the plurality of cable terminals extend along an insertion direction of the flexible cable into the connector further than the other cable terminals.

7. The control board according to claim 1, wherein the first terminal is located at one end of the connector in the first direction, and the sixth terminal is located at the other end of the connector in the first direction.

8. The control board according to claim 1, further comprising:

a buffer circuit connected to the fifth terminal and configured to store the voltage value of the second voltage.

9. The control board according to claim 1, further comprising:

a window comparator configured to detect whether the voltage value of the second voltage is within a predetermined range, wherein the processor is further configured to detect the connection error based on an output from the window comparator.

10. The control board according to claim 1, further comprising:

a head power supply circuit configured to supply power to the liquid ejection head, wherein the processor is further configured to control the head power supply circuit to supply the power if the connection error is not detected.

11. A liquid ejection device, comprising:

a liquid ejection head configured to eject a liquid;

a flexible cable; and a control board connected to the liquid ejection head via the flexible cable and including:

a power supply circuit configured to output a first voltage, a connector connected to the flexible cable through which the first voltage is input to the liquid ejection head and a second voltage is output from the liquid ejection head, and a processor configured to:

detect a connection error of the flexible cable using a difference between voltage values of the first and second voltages, and control the power supply circuit to turn off upon detection of the connection error, wherein the connector includes a plurality of terminals including:

first, second, and third terminals that are adjacent to each other and arranged along a first direction in this order and fourth, fifth, and sixth terminals that are adjacent to each other and arranged along the first direction in this order, the first voltage is input to the second terminal, the second voltage is output from the fifth terminal, and the first, third, fourth, and sixth terminals are ground terminals, and the second and fifth terminals are short-circuited in the liquid ejection head.

12. The liquid ejection device according to claim 11, wherein the processor detects the connection error when the voltage value of the second voltage is different from the first voltage.

13. The liquid ejection device according to claim 12, wherein the control board includes a memory, and the processor is further configured to store, in the memory, information indicating whether the connection error has been detected.

14. The liquid ejection device according to claim 12, wherein the processor detects the connection error when the voltage value of the second voltage is a ground voltage value.

15. The liquid ejection device according to claim 11, wherein two of a plurality of cable terminals of the flexible cable corresponding to the second and fifth terminals of the connector are longer than the other cable terminals.

16. The liquid ejection device according to claim 15, wherein the two of the plurality of cable terminals extend along an insertion direction of the flexible cable into the connector further than the other cable terminals.

17. The liquid ejection device according to claim 11, wherein the first terminal is located at one end of the connector in the first direction, and the sixth terminal is located at the other end of the connector in the first direction.

18. The liquid ejection device according to claim 11, wherein the control board includes a buffer circuit connected to the fifth terminal, and the buffer circuit is configured to store the voltage value of the second voltage.

19. The liquid ejection device according to claim 11, wherein the control board includes a window comparator configured to detect whether the voltage value of the second voltage is within a predetermined range, and the processor is further configured to detect the connection error based on an output from the window comparator.

20. The liquid ejection device according to claim 11, wherein the control board includes a head power supply circuit configured to supply power to the liquid ejection head, and the processor is further configured to control the head power supply circuit to supply the power when the connection error is not detected.

* * * * *